United States Patent [19]

Reid

[11] 4,195,294

[45] Mar. 25, 1980

[54] DUAL CHANNEL PROXIMITY FUZE

[75] Inventor: John D. Reid, Little Rock, Ark.

[73] Assignee: The United States of America as represented by the Secretary of the Navy, Washington, D.C.

[21] Appl. No.: 622,510

[22] Filed: Nov. 15, 1956

[51] Int. Cl.[2] ..... F42C 13/04; G01S 9/02

[52] U.S. Cl. ..... 343/7 PF; 102/214

[58] Field of Search ..... 343/7, 7 PF; 102/70.2 P, 214

[56] References Cited

FOREIGN PATENT DOCUMENTS 497107 10/1953 Canada ..... 343/7

585911 2/1947 United Kingdom ..... 102/70.2 P

*Primary Examiner*—Malcolm F. Hubler

*Attorney, Agent, or Firm*—A. L. Branning; R. S. Sciascia

EXEMPLARY CLAIM

1. A fuze for detonating a projectile in proximity to a target comprising, first normally effective transceiver channel means for effecting radiation of a first electromagnetic signal into space and for receiving electromagnetic signals therefrom, including any portion of said first radiated signal reflected from a target, second transceiver channel means initially ineffective to radiate and receive a signal adapted to being rendered effective for effecting radiation of a second electromagnetic signal into space and for receiving electromagnetic signals therefrom, including any portion of said second radiated signal reflected from a target, control circuit means for rendering said second channel means effective, and normally non-operating electroresponsive detonating circuit means adapted to being rendered operating by said channel means for detonating said projectile.

8 Claims, 1 Drawing Figure

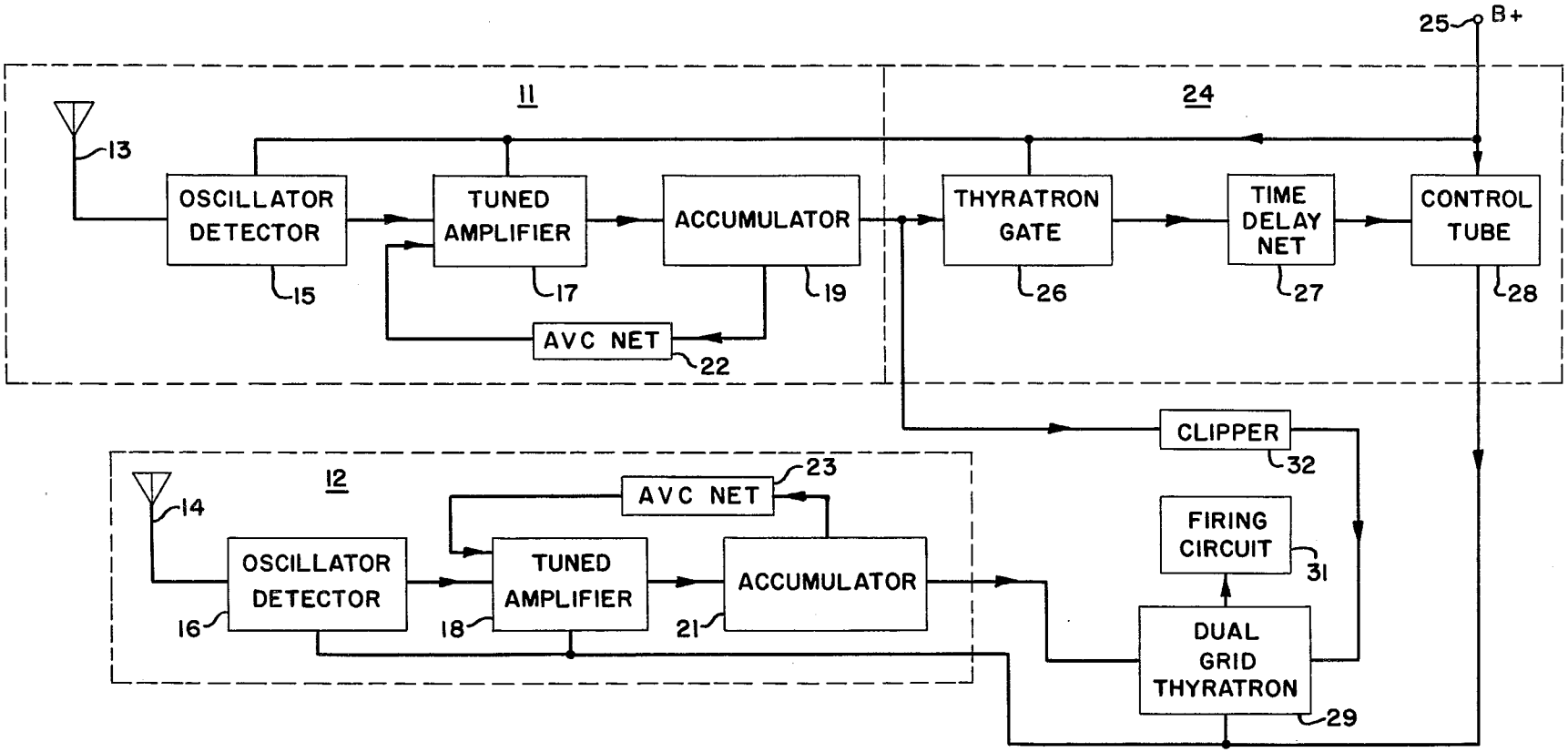
B+
25
CONTROL TUBE
28
TIME DELAY NET
27
THYRATRON GATE
26
24
CLIPPER
32
FIRING CIRCUIT
31
DUAL GRID THYRATRON
29
ACCUMULATOR
19
AVC NET
22
TUNED AMPLIFIER
17
OSCILLATOR DETECTOR
15
11
13
AVC NET
23
ACCUMULATOR
21
TUNED AMPLIFIER
18
OSCILLATOR DETECTOR
16
12
14

DUAL CHANNEL PROXIMITY FUZE

This invention relates generally to a proximity fuze for an ordnance vehicle, such for example, as a missile, or the like, and more particularly to an improved dual channel proximity fuze less susceptible to improper and premature firing from jamming signals and extraneous noises than heretofore devised.

Although noise and jammer resistant proximity fuzes have been heretofore devised and utilized, the majority of these have not operated entirely satisfactory under all adverse operation conditions. For example, a noise resistant circuit may minimize the adverse noise effects from microphonic tubes and loose electrical connections, such for example, as solder joints, but be responsive to environmental and battery generated noises. Additionally, the majority of existing jammer resistant circuits have been found to operate satisfactorily only against certain types of jamming signals thereby failing to provide the required overall jammer protection. For example, a particular jammer resistant circuit may render a fuze firing circuit immune from impulse type jamming signals but still prone to sweeping jammer signals.

Accordingly, one object of the present invention is to provide a new proximity fuze having improved discriminatory characteristics against extraneous noises and jammer signals than heretofore realized.

Another object of the present invention is to provide a new and improved proximity fuze incorporating dual channel firing circuits.

A further object of the present invention is to provide a new and improved dual channel proximity fuze requiring coincident signals of a predetermined character for effecting firing thereof.

A still further object of the present invention is the provision of a new and improved signal discriminating transceiver circuit arrangement Other objects and many of the attendant advantages of the present invention will be readily appreciated as the same becomes better understood by reference to the following detailed description when considered in connection with the accompanying drawing wherein the sole FIGURE is a block diagrammatic illustration of the improved proximity fuze according to the present invention.

As shown on the FIGURE, the proximity fuze circuit includes a pair of substantially identical transceiver channels, generally indicated by the reference numerals 11 and 12, respectively, each channel comprising an antenna, 13 and 14, for transmitting a high frequency signal generated by the oscillator portion of an oscillator-detector, 15 and 16, into space and for receiving any target reflected or other high frequency signal in the immediately surrounding spatial area. Upon signal reception by either antenna, the received signal is fed to the respective oscillator-detector circuit wherein it is mixed with the respective oscillator generated signal to produce a beat, or ripple, signal output for selective amplification by a tuned bandpass ripple amplifier 17 and 18. Amplifiers 17 and 18 are tuned in a manner to produce an output signal of usable magnitude only for a predetermined band of input ripple signals which are indicative of target proximity. To insure target proximity within a lethal range of the ordnance missile, and to provide discrimination against jammer signals, the amplified output signals of amplifiers 17 and 18 are fed into integrating, or accumulator, networks 19 and 21 respectively whereby prolonged or continuous signals in channels 11 and 12 are required for producing an output signal from their accumulator circuits. An AVC network 22,23 is provided in each channel for reducing the amplifier 17,18 gain upon reception of signals above a threshold level in a manner well known in the transceiver art.

Although, in general, the circuitry and operational characteristics of channels 11 and 12 may be substantially identical, operational differences exist between the dual channels in that the gain of channel 11 is substantially greater than the gain of channel 12 and the oscillator generated signals are of substantially divers frequencies. Additionally, energization of the componential circuits in channel 12 is delayed by the operation of an energizing control circuit, generally indicated by the reference numeral 24, interposed between the B+, or energizing potential, source 25 and channel 12.

Energizing control circuit 24 includes a thyratron gate, or switch, 26 normally biased to a non-conducting condition connected through a time delay network 27 to a normally heavily cut-off control tube circuit 28, thereby initially interrupting the flow of energization energy from potential source 25 to channel 12 and thyratron 29.

The reception of a suitably prolonged and continuous target reflected signal by channel 11 results in the development of an initiating signal for rendering the gas triode 26 conductive whereupon after a predetermined duration of time, as determined by the time delay network 27, which may be a conventional R-C network, the control tube 28 is rendered conductive thereby applying the available potential from source 25 across channel 12 for energization thereof. Energization of channel 12 results in the transmission of another suitable high frequency signal simultaneously with the signal transmitted from channel 11, whereby target interception and reflection will result in coincident signal reception by the dual channels. If the received signals are continuous and prolonged, as they will be if target reflected, coincident ionization signals will be developed by accumulator circuits 19 and 21 which upon transmission to the respective control grids of a normally non-conducting dual grid thyratron or gate 29 will render said gas tube conductive whereupon the firing circuit, or utilization device 31, such for example, as the firing circuit described in "Proximity Fuzes for Artillery" by H. Selvidge appearing on page 104 of "Electronics", February 1946, will be rendered operative.

The operating characteristics of the novel dual channel proximity fuze according to the present invention which results in an improved jammer discriminating fuze will now be more completely described. The inclusion of an accumulator, or integrating network, in each channel renders the fuze immune to pulse and sweep jamming signals by requiring a continuous received signal or predetermined number of cycles of amplified signals, to develop a suitable thyratron initiating signal. Additionally, the incorporation of a discharge path within the accumulators 19 and 21 whereby the partial charge existing thereon from a short duration, or interrupted signal, functions to render the fuze immune to present repeat jammer techniques due to the short duty cycles thereof.

The utilization of dual transceiver channels of different oscillator frequencies improves the jammer discriminating abilities of the fuze in view of the inability of present day sweep jammers to simultaneously transmit different frequency jamming signals. Moreover, the requirement for coincident ignition signals upon dual gas triode tube 29 minimizes the jamming probabilities of a plurality of jammers transmitting jammer signals of divers frequencies. If the operating frequencies of the dual channels were known and a plurality of continuous wave spot jammers transmitting at those frequencies were used against a fuze according to the present invention, the initially non-energized condition of channel 12 and the time delay inherent in energizing control circuit 24 would enable the fuze to reach a more lethal range to the target before ignition thereof than presently used jammer resistant fuzes are capable of reaching.

A clipper circuit 32 is introduced between the accumulator of channel 11 and the dual grid thyratron 29 to prevent the possibility of the gas tube being rendered conductive by an exceedingly large microphonic signal from channel 11, as might be generated upon shock, salvo, or missile launching. The clipper 32 operates to limit the amplitude of the channel initiating signal below the single signal initiating level of gas tube 29. Moreover, should channel 12 be energized by a microphonic tube in channel 11, or by the effects of snow, rain, etc., the lower gain characteristic of channel 12 would require an even more microphonic tube or snow, rain, etc., effects to fire dual thyratron 29.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A fuze for detonating a projectile in proximity to a target comprising, first normally effective transceiver channel means for effecting radiation of a first electromagnetic signal into space and for receiving electromagnetic signals therefrom, including any portion of said first radiated signal reflected from a target, second transceiver channel means initially ineffective to radiate and receive a signal adapted to being rendered effective for effecting radiation of a second electromagnetic signal into space and for receiving electromagnetic signals therefrom, including any portion of said second radiated signal reflected from a target, control circuit means for rendering said second channel means effective, and normally non-operating electroresponsive detonating circuit means adapted to being rendered operating by said channel means for detonating said projectile.

2. A fuze according to claim 1 wherein said first and said second radiated electromagnetic signals are of different frequencies.

3. A fuze according to claim 1 wherein said first and said second transceiver channel means each includes an oscillator for generating an electromagnetic signal, an antenna coupled to said oscillator for transmitting and receiving electromagnetic signals, a detector coupled to said oscillator for developing a beat frequency signal relative to said transmitted and received signals, and a frequency selective amplifier circuit coupled to said detector for developing an amplified output signal proportional to said beat frequency signal.

4. A fuze according to claim 3 wherein said first and said second transceiver channels each further include an accumulator circuit for developing an initiating signal in response to a predetermined number of said amplified output signals, and an AVC network for feeding back a signal from said accumulator circuit to said amplifier circuit.

5. A fuze according to claim 1 wherein said control circuit means includes an initially non-conducting gas discharge device coupled to said first transceiver channel means and adapted to being rendered conductive thereby, and an initially conducting electron discharge device operatively coupled to said gas discharge device and being adapted to be rendered substantially less conductive in response to said gas discharge device being rendered conductive.

6. A fuze according to claim 5 wherein said control circuit means further includes a time delay network interposed between said gas discharge device and said electron discharge device.

7. A fuze according to claim 1 wherein said electroresponsive detonating circuit means includes a normally non-conductive gating device adapted to be rendered conductive in response to a pair of coincident signals from said first and said second transceiver channels, and circuit means interconnecting said channels and said gating device for effecting the transfer of said coincident signals to said gating device.

8. A fuze according to claim 7 wherein said interconnecting circuit means includes a clipper circuit for selectively controlling the amplitude of one of said pair of coincident signals.

* * * * *